US006918511B1

(12) United States Patent
Spatz et al.

(10) Patent No.: US 6,918,511 B1
(45) Date of Patent: Jul. 19, 2005

(54) FLOW CONTROL PRODUCT DISPENSER

(75) Inventors: Walter B. Spatz, Pacific Palisades, CA (US); Monroe A. Cochran, Ojai, CA (US); Jeffrey J. Hager, Camarillo, CA (US)

(73) Assignee: Spatz Laboratories, Oxnard, CA (US)

( * ) Notice: Subject to any disclaimer, the term of this patent is extended or adjusted under 35 U.S.C. 154(b) by 190 days.

(21) Appl. No.: 10/463,115

(22) Filed: Jun. 17, 2003

(51) Int. Cl.[7] ..... A45D 40/04

(52) U.S. Cl. ..... 222/109; 222/390; 401/68; 401/75; 401/174; 401/175

(58) Field of Search ..... 222/108, 109, 222/390; 401/68, 75, 174, 175

(56) References Cited

U.S. PATENT DOCUMENTS

| | | | | |
|---|---|---|---|---|
| 3,756,730 A | | 9/1973 | Spatz | |
| 4,950,094 A | * | 8/1990 | Yorks | 222/390 |
| 5,000,356 A | | 3/1991 | Johnson et al. | |
| 5,540,361 A | | 7/1996 | Fattori | |
| 5,547,302 A | * | 8/1996 | Dornbusch et al. | 401/68 |
| 5,697,531 A | | 12/1997 | Fattori | |
| 5,725,133 A | | 3/1998 | Iaia | |
| 5,803,640 A | * | 9/1998 | Nakajima et al. | 401/174 |
| 5,839,622 A | * | 11/1998 | Bicknell et al. | 222/390 |
| 5,879,096 A | | 3/1999 | Franta et al. | |
| 5,961,007 A | * | 10/1999 | Dornbusch et al. | 222/390 |
| 6,086,276 A | | 7/2000 | Gueret | |
| 6,398,439 B1 | * | 6/2002 | Szekely | 401/75 |

* cited by examiner

*Primary Examiner*—Kenneth Bomberg
(74) *Attorney, Agent, or Firm*—Kenneth J. Hovet

(57) ABSTRACT

A dispensing device comprising a container with product outlets, a screw that operates a piston within the container and a torsion spring that biases the screw. The torsion spring includes a hoop having one or more inner tabs. The hoop is frictionally engaged with an interior surface of the container. A boss is fixed to the screw and a flexible arm interconnects the hoop and boss. The torsion spring also includes a spoke that is angularly offset from the flexible arm. Application of a rotational force to the screw urges the piston toward the container outlets, causing the flexible arm to yield, allowing the boss to rotate relative to the hoop until the spoke engages an inner tab. Further rotation releases the hoop from frictional engagement with the container. Once the rotational force is removed, the hoop re-engages the container interior surface and the flexible arm regains its original shape, causing the hub and screw to counter-rotate, which simultaneously moves the piston away from the fluid outlets.

20 Claims, 3 Drawing Sheets

FLOW CONTROL PRODUCT DISPENSER

BACKGROUND OF THE INVENTION

1. Field of the Invention

The present invention pertains generally to viscous product dispensing systems. More particularly, the invention pertains to product dispensers that eliminate residual product leakage from the dispenser (commonly known as the "drool effect") after the actual amount of product that is desired by the user has been dispensed. Additionally, the invention relieves residual pressure within the dispenser which helps reduce product degradation caused by ingredient separation.

2. Description of Related Art

Systems for dispensing viscous flowable materials such as soft-solid deodorant/antiperspirant products, are well-known in the prior art. Typically, the product is extruded out of a container via a plurality of openings that are located at the top of the container. To do this, a chamber in the interior of a dispenser is loaded with the desired product. The product is supported by an underlying structure, such as a platform, piston or elevator. The user manipulates a thumbwheel or a slider which moves the underlying structure toward the top of the container. This action causes the product to be expelled out through the top openings.

One of the inherent problems with the prior art devices is that moving the underlying structure toward the top of the container, decreases the volume of the interior chamber. This pressurizes the product, which causes an additional small amount of product to be expelled through the openings, even after the user has already dispensed the desired amount of product and the user has stopped moving the underlying structure toward the top of the container. The result is a slight oozing, or weeping, of product out of the container top openings (known as the "drool" effect). The drool effect is undesirable in the liquid dispenser manufacturing industry, and it is desired to produce a viscous product dispenser that eliminates this effect. Moreover, the elimination of residual pressure on the product, will inhibit product degradation caused by ingredient separation. This most commonly occurs in fluid and fluid solid multiple component mixtures.

U.S. Pat. No. 5,540,361, which issued to Fattori for an invention entitled "Cream Deodorant Dispenser," discloses an elevator cup 11 with a spring element 12 which extends into a first portion and into a second portion of the elevator cup. Differential flexing between the first portion and the second portion during dispensing of the product results in a retracting force that slightly withdraws the elevator cup when dispensing is stopped.

A problem with the Fattori device is that the first portion, second portion and spring element are a continuous structure. This produces an unpredictable diaphragm-like action resulting in erratic movement of the elevator cup.

U.S. Pat. No. 5,879,096, which issued to Franta et al. for an invention entitled "Gel/Cream Applicator," discloses an intermittently rotatable spindle with threads having discrete valleys on their upper surfaces. Pins from an elevator follow the upper surfaces during rotation of the spindle. The elevator slightly retracts to prevent product drool, whenever the pins move into the valleys.

The problem with the Franta et al. device is the upper surface valleys provide the same amount of retraction no matter what amount the fluid is pressurized. Therefore, the device does not always compensate for variations in fluid pressure, and unwanted leakage can occur.

In light of the above, it is an object of the present invention to provide a dispenser for viscous products that eliminates residual pressure on the product. It is another object of the present invention to provide a dispenser wherein product leakage is prevented when the user stops extruding product from the container. Another object of the present invention to provide a dispenser wherein the user easily manipulates the dispenser to distribute product. Yet another object of the present invention is to provide a dispenser with as few moving parts as possible for increased reliability of operation. Another object of the present invention is to provide a dispenser that is easy to assemble and manufacture in a cost-effective manner.

SUMMARY OF THE INVENTION

A device for dispensing a viscous product in accordance with the present invention basically comprises a container having a top opening and interior surfaces which define a chamber. A screw and piston assembly extend into the chamber and a torsion spring is attached to the screw. The torsion spring is also frictionally engaged with the interior surfaces to effect a counter rotational force to the screw.

The screw is attached for rotation to the bottom of the container so that it extends into the chamber. A piston is threaded onto the screw, and is frictionally engaged with the interior surface of the chamber. Rotation of the screw urges the piston towards or away from the top opening, according to the direction of rotation of the screw.

The torsion spring includes an outer hoop that is frictionally engaged with the interior surface of the container and an inner concentric boss that is fixed to the screw. At least one flexible arm interconnects the boss with the hoop. The flexible arm includes a boss tab that extends radially outward from the boss and merges into an elongated flex portion. The flex portion is connected to the terminal end of an abutment means that projects radially inward from the hoop.

To rotationally bias the torsion spring by a predetermined amount, at least one spoke is fixed to the boss so that it extends radially outward a distance sufficient to overlap the abutment means. The spoke is offset radially from adjacent flexible arms by a predetermined angular amount, preferably in a range of thirty to seventy degrees. In an alternative embodiment of the invention, the abutment means may comprise one or more bias tabs. These tabs are unconnected to the flex portion and extend inwardly from selected points of the hoop a distance sufficient to engage a spoke. In this alternative, each spoke will be angularly offset from an adjacent bias tab.

When the screw is rotated to dispense product, the piston will move towards the container top openings. The boss will simultaneously rotate with the screw. Since the hoop is frictionally engaged with the chamber interior surface, it remains stationary while the boss rotates with respect to the hoop. This action causes the leg members to twist out of their normal U-shape and develop a counter-rotational bias. As the screw, boss and attached spoke continue to rotate, the spoke will come into contact with the abutment means such as a hoop tab or a bias tab. Once the spoke becomes engaged with a tab, the screw will have been rotated by the predetermined angular amount. Thereafter, further rotation of the screw will overcome the hoop's frictional engagement with the interior surface of the container, and the entire torsion spring will rotate as an integral unit within the container.

When the desired amount of product has been dispensed and rotation of the screw is discontinued, the hoop will frictionally re-engage the interior surface of the container. Upon re-engagement, the twisted leg members will counter-rotate back to their original at-rest position. This causes the hub and screw to likewise counter-rotate in a direction opposite from the original direction of rotation by the predetermined angular amount. The counter-rotation translates into a reverse downward movement of the piston away from the container top openings. This movement neutralizes any pressure build-up in the chamber and thereby prevents unwanted product degradation and subsequent leakage out of the container top openings.

To further inhibit undesired product flow out of the container top openings, the openings may have a beveled cross-section. In this variation, each opening will increase in diameter from an outlet diameter to a larger inlet diameter. The larger inlet will provide an enlarged space for accumulating product from any increased pressure that may be present after operation of the screw and piston. Additionally, the inward taper helps to accelerate withdrawal of the product as the piston retracts.

BRIEF DESCRIPTION OF THE DRAWINGS

The novel features of this invention will be best understood from the accompanying drawings and description, in which similar characters refer to similar parts, and in which.

DESCRIPTION OF THE PREFERRED EMBODIMENTS

Figure 1:
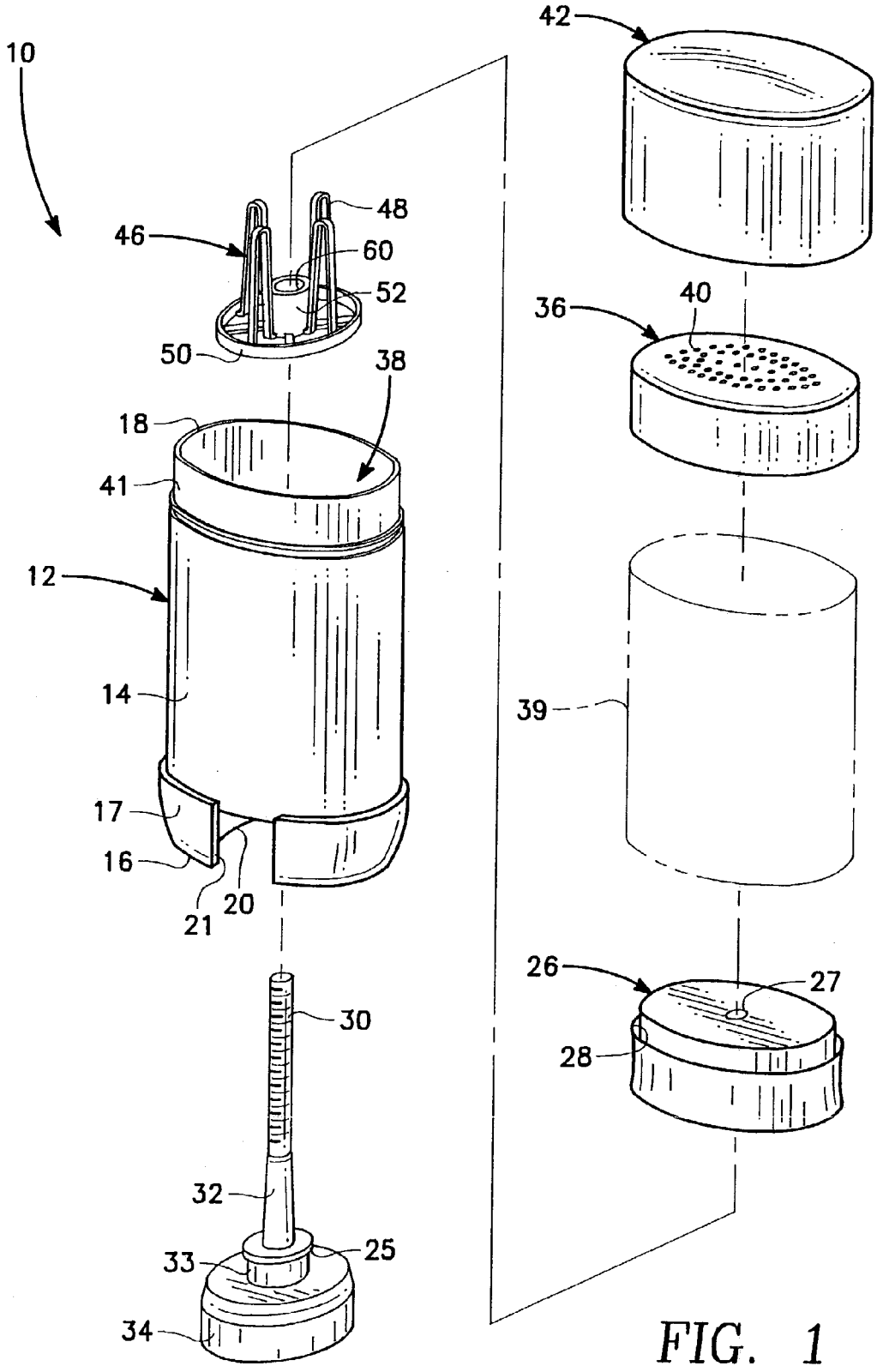
FIG. 1 is an exploded isometric view of the product dispenser of the present invention.
Figure 2:
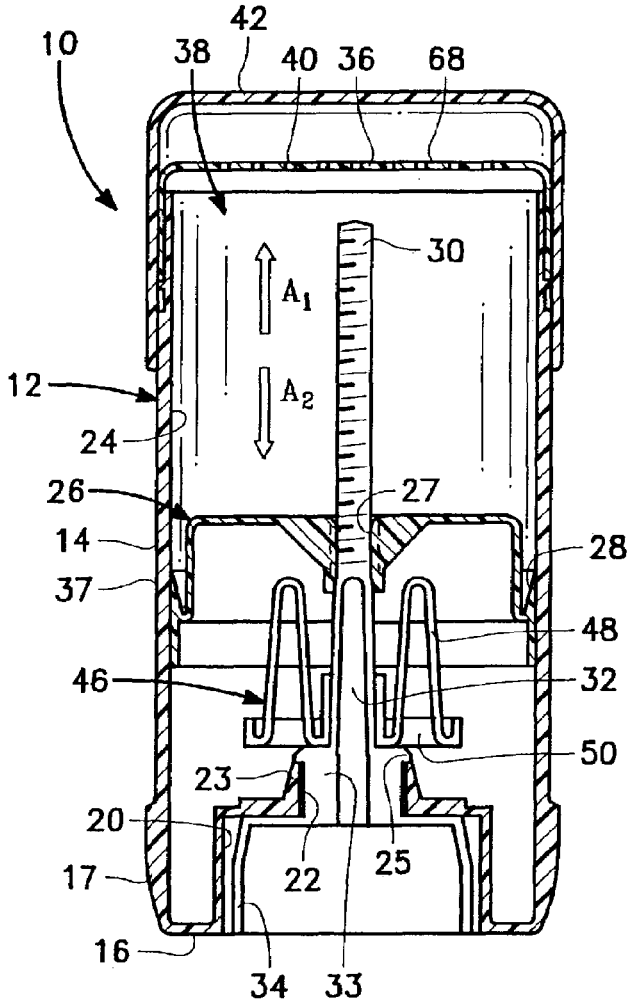
FIG. 2 is a cross-sectional view of a frontal aspect of the dispenser of FIG. 1.
Figure 3:
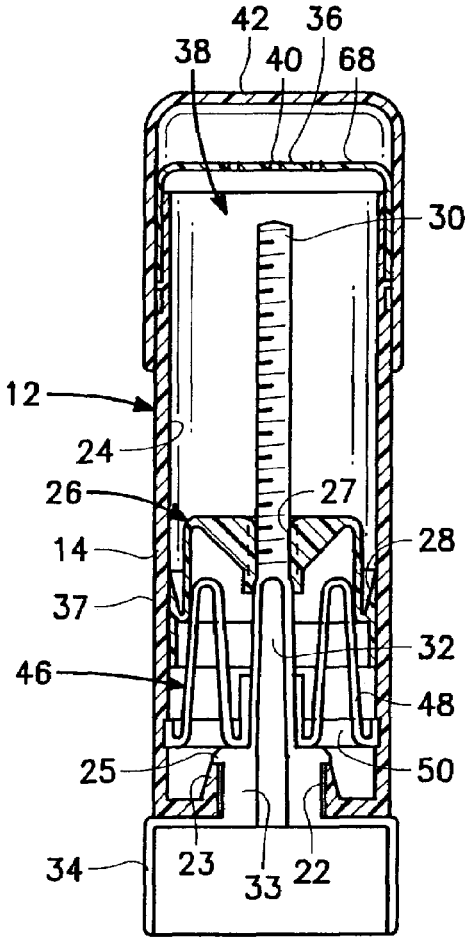
FIG. 3 is a cross-sectional view of a side aspect of the dispenser of FIG. 1.
Figure 5:
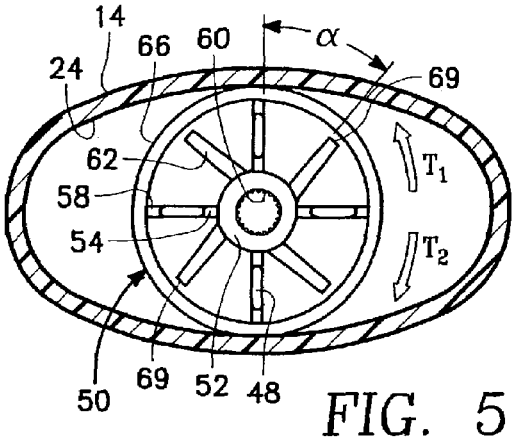
FIG. 5 is a top plan view of the torsion spring and container of FIG. 1 before operation of the dispenser.
Figure 6:
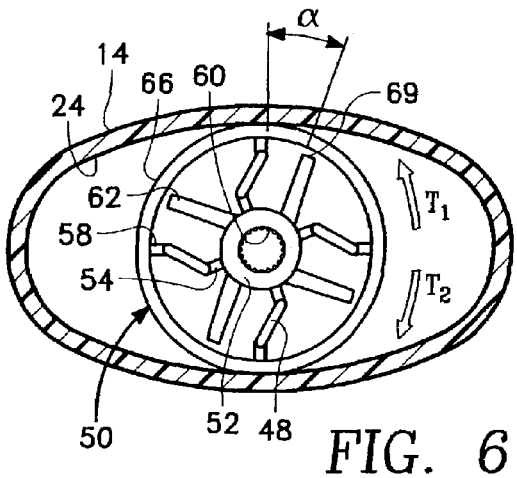
FIG. 6 is the same view as FIG. 5 after initial operation of the dispenser but while the outer hoop portion of the torsion spring is still frictionally engaged with the interior surface of the container.
Figure 7:
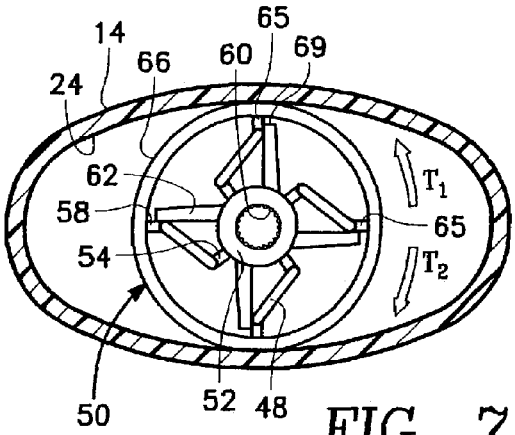
FIG. 7 is the same view as FIG. 6 after the hoop portion of the torsion spring has disengaged from the container interior surface and is rotating within the container.
Figure 8:
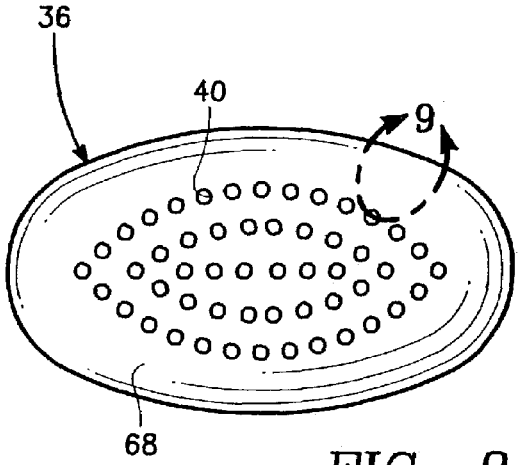
FIG. 8 is a top plan view of the cap of FIG. 1.

Referring now to the Figures, the product dispenser is shown and is generally designated by reference character 10. The dispenser comprises a container 12 with a continuous sidewall 14 that extends upwardly from a bottom 16 and terminates at a top opening 18. Bottom 16 further includes a bottom recess 20 and a bottom opening 22 that is formed in the bottom recess 20, as shown in FIGS. 1–3. Preferably, the container should have an oval shaped profile when viewed in top plan, as best seen in FIGS. 5–7. It will be appreciated, however, that square, rectangular or other polygonal profiles (as viewed in top plan) are also envisioned. However, the container should have an interior surface 24 which allows for frictional engagement with other components of the dispenser, as described more fully below.

The dispenser of the present invention includes an integrated elevator assembly comprising a screw 30 that extends longitudinally within the container and along the geometrical center axis of the container. The screw is the threaded upper portion of a post 32. The post projects upwardly from a hub 33. The hub is centered co-extensively above thumbwheel 34.

The elevator assembly is positioned within bottom recess 20 so that annular lip 25 of hub 33 will engage spaced-apart upwardly and inwardly extending deflectable retention flanges 23. The flanges define bottom opening 22.

In the above position, screw 30 will extend into the container interior, while the thumbwheel 34 is nested within the bottom recess 20. Opposing sides of bottom wall 17 are provided with respective cut-outs 21. The cut-outs provide convenient access to the thumbwheel so that the thumbwheel can be rotated by a user's thumb and fingers in a manner known in the art.

To allow for placement of a viscous product (not shown) therein, a piston 26 is positioned within the container. The piston includes a threaded opening 27 and a skirt 28 that extends around its periphery. The piston has an outer circumference that closely conforms to the geometric profile of the container sidewall when viewed in top plan. Therefore, when the piston is placed within the container and threaded onto screw 30, the skirt will engage interior surfaces 24 and prevent downward leakage of product into the lower regions of the dispenser.

As shown in FIGS. 1–3, the dispenser of the present invention also includes a cap 36 that is attached to the inset outer surface 41 of the container sidewall 14. Once attached, container cap 36, sidewall 14 and piston 26 cooperate to establish a chamber 38 within the container. The chamber provides for placement and storage of a viscous dispensable product therein, as mentioned above and depicted in phantom by volume 39 in FIG. 1. The product may comprise any type, or combination of, flowable material such as a semi-solid stick, paste, dough, putty, a powder or particulate matter, fluid, gel, cream or liquid.

The container cap includes a plurality of outlet apertures 40 to provide a path of product communication out of chamber 38. The outlets function to deliver the product to an end user. A lid 42 can be removably placed over the cap when the dispenser is not in use.

The dispenser of the present invention also includes a torsion spring 46 that is fixed to post 32 between piston 26 and hub 33 of the elevator assembly. The torsion spring biases the rotation of the screw in a manner more fully described below, when the operator manipulates the thumbwheel.

The torsion spring 46 comprises a plurality of flexible arms 48 that interconnect a hoop 50 with a boss 52. The boss is oriented concentric to the hoop 50. The hoop has a diameter that is sufficient to frictionally engage at least opposite portions of container interior surface 24. The boss includes a center opening 60. To fix the torsion spring within the container, the screw is inserted into the center opening, until post 32 engages the center opening. In this position, the post may be fixed to the boss by adhesion, fusion-bonding or mechanical means known in the art.

In an alternative embodiment of the present invention, the inner surface of center opening 60 and the corresponding outer surface of post 32 may be serrated or polygonal in cross-section. This provides a mechanical connection for ensuring that rotation of spring boss 52 will be in unison with screw 30. However, outer surface 66 of spring hoop 50 and the corresponding inner surface of the container 24 may be serrated to achieve an audible and tactile click upon rotation of the actuator thumbwheel. This construction may also augment frictional engagement of the spring hoop to the container wall until a calculated degree of rotation is achieved.

Referring now primarily to FIGS. 4–7, the aforementioned torsion spring 46 is shown in greater detail. Each flexible arm 48 includes a boss tab 54 and a flex portion 56. For each flexible arm, the boss tab is fixed to boss 52 and extends radially outward until it merges into flex portion 56. The flex portion has an elongated inverted U-shape having an outer end that merges into an abutment means shown as hoop tab 58.

Figure 4:
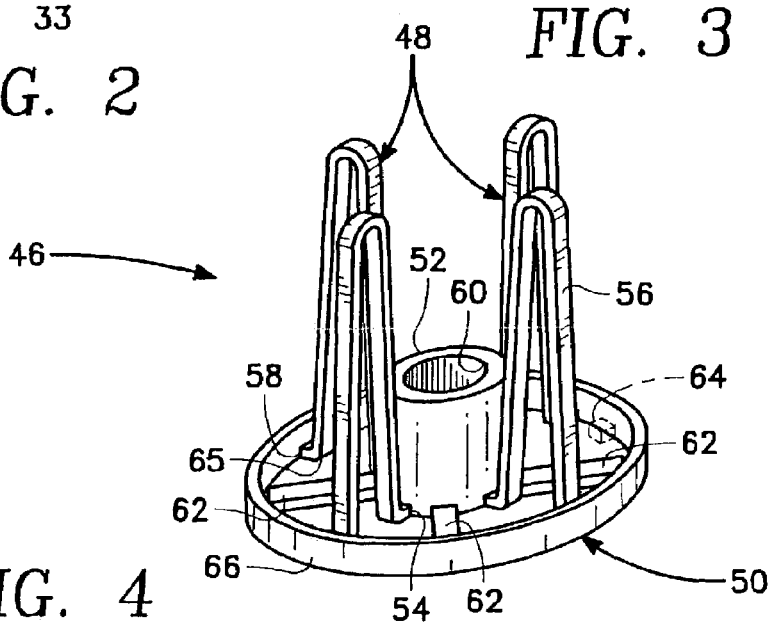
FIG. 4 is an isometric view of the torsion spring for the dispenser of FIG. 1.

The hoop tab is fixed to the hoop and extends radially inward to an inner terminal end 65, where it merges with the flex portion outer end. The boss tab and hoop tab are oriented so that they are about co-planar, while the flex portion extends about perpendicularly from the plane defined by boss tab 54 and hoop tab 58, as best seen in FIG. 4.

The torsion spring of the present invention also includes a plurality of spokes 62, with each spoke corresponding to a respective flexible arm 48. The spokes are fixed to boss 52 and extend radially and angularly outward to a free end 69 that is beyond terminal end 65 of the hoop tab, for reasons to be described. The spokes are substantially co-planar with the above-mentioned plane defined by the hoop, boss tabs and hoop tabs. Further, each spoke is angularly offset from the corresponding hoop tab for its respective flexible arm by an angle $\alpha$. The optimum amount of angular offset is determined by the screw thread lead and the desired amount of piston retraction. For a 0.18 inch thread lead and 0.020 inch piston retraction, a 40-degree angular offset is required, as depicted in FIG. 5. This feature is application-dependent and customized according to the product being dispensed. Most commonly, the amount of angular offset is within a range of 20 to 70 degrees (a=30–70°).

In an alternative embodiment of the invention, bias tabs 64 can be included with the torsion spring of the present invention. An exemplary bias tab is shown in phantom in FIG. 3. With this configuration, the bias tabs are fixed to the hoop and extend radially inwardly therefrom. For this embodiment, the spokes will be fixed to the boss so that they extend radially outward past the terminal end of the bias tabs. Further, the spokes will be angularly offset from the bias tabs by angle $\alpha$, instead of being angularly offset from the hoop tab portions of the flexible arms as also discussed above. In this way, the bias tabs will function as a spoke abutment means instead of the hoop tabs.

It is to be appreciated that although four spokes and four flexible arms are used in the preferred embodiment, as little as one spoke and corresponding flexible arm structure could be used to accomplish the counter-biasing effect of the torsion spring. It is important that the overall biasing force created by the flexible arm(s) be sufficient to counter-rotate the screw. However, the overall force must be less than the force of frictional engagement between interior surfaces 24 and hoop 50.

Figure 9:
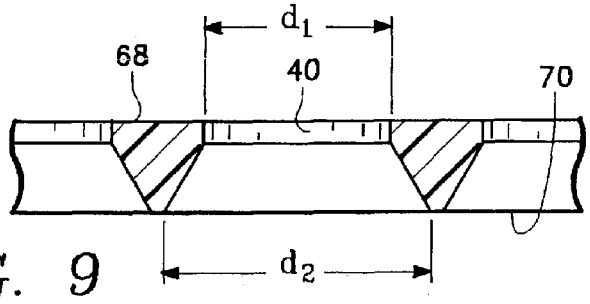
FIG. 9 is an enlarged cross-sectional view taken along line 9 in FIG. 8.

To further minimize unwanted product flow from the chamber 38, a variation of the invention is shown in FIG. 9. In this version, the outlet apertures 40 are beveled. More specifically, the apertures have an increasing diameter from a minimum diameter $d_1$ at outer cap surface 68 to a maximum diameter $d_2$ at inner surface 70. This configuration provides an enlarged space for dissipating residual product pressure and a restriction to flow from chamber 38 that occurs during operation of the dispenser.

In the preferred embodiment, the screw, container, thumbwheel, cap and lid are preferably injection molded plastic, such as a high density polyethylene (HDPE), a polypropylene, or a resin material having similar physical properties. The torsion spring is preferably made from an acetal plastic or similar material with properties that allow for flexure of the torsion spring during operation of the dispenser.

Operation

To dispense a viscous product from the above-described device, the user exerts a first rotational force by manually rotating thumbwheel 34 clockwise. This will rotate screw 30 and provide a torque in the direction indicated by arrow $T_2$ (See FIGS. 5–7). Rotational motion of the screw within a threaded opening 27 of piston 26 becomes translated into axial movement of the piston, which is otherwise constrained from rotational movement. The piston thereby moves toward the container opening, as indicated by arrow $A_1$ in FIG. 2.

As the piston moves toward the container top opening 18, the volume of chamber 38 is decreased. The decrease in chamber volume causes the viscous product therein (which is substantially incompressible) to flow from the chamber through outlet apertures 40 and be delivered for use by the operator.

During the above events, the flexible arms 48 yield and flex to allow rotation of the boss and spokes, while the hoop remains stationary by its frictional engagement with interior surface 24. Rotation continues until the spokes reach the full extent of angle $\alpha$. At this position, each spoke contacts an inwardly extending respective hoop tab 58 (or bias tab 64 for the alternative embodiment). The overlapping spoke-to-hoop tab engagement is best seen in FIG. 7.

Once the spoke(s) abut against the hoop tab(s), continued application of sufficient rotational force via thumbwheel 34 will overcome the frictional engagement of circumferential surface 66 of the hoop with interior surface 24 of the container. Simultaneously, the piston continues to move upwardly and expel fluid through outlet apertures 40.

When the desired amount of fluid has been delivered, the user will cease rotating thumbwheel 34. This action will result in a re-engagement of the outer circumferential surface 66 of hoop 50 with interior surfaces 24. With the hoop in a stationary mode, the flex portions 56 of flexible arms 48 exert a second rotational force and become unflexed. The arms return to their relaxed state as shown in FIG. 5. As the flexible arms return to their relaxed state, boss 52 and the attached screw counter-rotate by angle $\alpha$, in the direction indicated by arrow $T_1$. This reverse rotation will translate into a short downward movement of piston 26 in the direction indicated by arrow $A_2$. As the piston moves away from the container top opening, the volume of chamber 38 is slightly increased. The increased volume relieves any residual pressure on the viscous product in the chamber. Dissipation of residual pressure thereby eliminates the cause of unwanted product flow after rotation of the thumbwheel has stopped. Such dissipation also eliminates degradation of product as a result of ingredient separation.

While the product dispenser, as herein shown and disclosed in detail, is fully capable of obtaining the objects and providing the advantages above stated, it is to be understood that the presently preferred embodiments are merely illustrative of the invention. As such, no limitations are intended other than as defined in the appended claims.

We claim:

1. A device for dispensing a product comprising:

a container having an outlet and an interior surface defining a chamber in communication with said outlet;

a screw in communication with a first rotational force, said screw being rotatably attached to said container and extending into said chamber; and, a torsion spring fixed to said screw and frictionally engaged with said interior surface, said torsion spring being biased to exert a second rotational force that is counter to said first rotational force by a predetermined angular amount.

2. The device of claim 1 further comprising:

a piston threaded onto said screw for slidable engagement within said interior surface, said piston moving toward said outlet in response to said actuating force.

3. The device of claim 2 wherein said torsion spring further comprises:

a boss fixed to said screw;

a hoop frictionally engaged with said interior surface; and, at least one flexible arm interconnecting said boss and said hoop.

4. The device of claim 3 further comprising at least one spoke extending radially outward from said boss.

5. The device of claim 4 wherein said spoke is angularly offset from said flexible arms by said angular amount.

6. The device of claim 4 further comprising at least one abutment means for engaging said spoke attached to said hoop and extending radially inward, said abutment means corresponding to said spoke and being angularly offset from said spoke by said angular amount.

7. The device of claim 5 wherein said angular amount is between thirty to seventy degrees ($\alpha$=30°–70°).

8. The device of claim 5 wherein said torsion spring has a first configuration, wherein said hoop is frictionally engaged with said interior surface and wherein said spoke is angularly offset from said flexible arm by said angular amount.

9. The device of claim 8 wherein said torsion spring has a second configuration, wherein while said first rotational force is being applied, and when said spoke is engaged with an abutment means, said hoop becomes frictionally disengaged from said interior surface.

10. The device of claim 9 wherein said screw counter-rotates by said angular amount to move said piston away from said opening when said actuating force is discontinued and said torsion spring changes from said second configuration to said first configuration.

11. The device of claim 1 wherein said outlet comprises:

an applicator cap attached to said body having at least one outlet aperture.

12. The device of claim 11 wherein said cap has an outer surface and an inner surface and said outlet aperture is beveled with an increasing diameter from a first diameter at said outer surface to a second diameter at said inner surface.

13. A product dispensing assembly comprising:

a container having a bottom with an upstanding sidewall that terminates at a top opening, said sidewall further having an interior surface;

a screw attached to said bottom, said screw extending into said container;

a hoop frictionally engaged with said interior surface and being attached to said screw by at least one flexible arm; and, said arm permitting rotation of said screw by a predetermined angular amount before frictional disengagement of said hoop from said interior surface in response to an actuating force on said screw.

14. The assembly of claim 13 further comprising:

a boss attached to said screw; and, said flexible arm connecting said hoop to said boss.

15. The assembly of claim 14 further comprising:

at least one spoke fixed to said boss and extending radially outward from said boss, said spoke being angularly offset from said flexible arm by said angular amount.

16. The assembly of claim 14 further comprising:

at least one abutment tab attached to said hoop and extending radially inward therefrom; and, at least one spoke corresponding to said abutment tab, said spoke being attached to said boss so that it is angularly offset from said flexible arm by said angular amount.

17. The assembly of claim 13 further comprising:

a piston threaded onto said screw for slidable engagement with said interior surface, said piston moving toward said opening in response to said actuating force.

18. The assembly of claim 17 wherein said flexible arm becomes biased in a reverse direction from the direction of rotation of said screw while said hoop is frictionally engaged with said interior surface.

19. A process for dispensing a flowable product from a container comprising the steps of:

a) providing a container having a product outlet and an interior surface defining a chamber containing said product;

b) attaching a screw to said container so that said screw can rotate and extend into said chamber;

c) fixing a torsion spring to said screw so that said spring is frictionally engaged with said interior surface;

d) threading a piston onto said screw between said torsion spring and said outlet so that said piston cooperates with said container to hold said product in said chamber;

e) rotating said screw in a first direction by an amount that is sufficient to create a reverse bias in said torsion spring in a direction opposite to said first direction and disengage said torsion spring from said interior surface;

f) continuing to rotate said screw until a selected amount of said product has moved through said outlet;

g) discontinuing rotation of said screw; and, h) reversing the rotation of said screw by said reverse bias.

20. The method of claim 19 further comprising the step of:

i) after step g) and before step h), frictionally re-engaging said spring with said interior surface.

* * * * *